US008157086B1

(12) United States Patent
Gallegos et al.

(10) Patent No.: US 8,157,086 B1
(45) Date of Patent: Apr. 17, 2012

(54) FINANCIAL TRANSACTION CARD PACKAGING HAVING REMOVABLE PORTION

(75) Inventors: Michael Gallegos, Portland, OR (US); Amy Paldi, Portland, OR (US); Shelle B. Pascua, Sherwood, OR (US); Scott Mitton, Tualatin, OR (US); Kevin L. Christensen, Lake Oswego, OR (US)

(73) Assignee: Taylor Corporation, North Mankato, MN (US)

( * ) Notice: Subject to any disclaimer, the term of this patent is extended or adjusted under 35 U.S.C. 154(b) by 31 days.

(21) Appl. No.: 12/609,854

(22) Filed: Oct. 30, 2009

(51) Int. Cl.
*B65D 69/00* (2006.01)

(52) U.S. Cl. ..... 206/232; 235/380; 206/39.7; 229/71

(58) Field of Classification Search ..... 206/216, 206/232, 39.7; 283/62, 106; 235/486, 380; 428/78, 63; 229/71
See application file for complete search history.

(56) References Cited

U.S. PATENT DOCUMENTS

| | | | | |
|---|---|---|---|---|
| 5,842,629 | A * | 12/1998 | Sprague et al. | 229/71 |
| 6,109,439 | A | 8/2000 | Goade, Sr. | |
| 6,227,504 | B1 * | 5/2001 | Seaberg | 248/174 |
| 6,315,206 | B1 | 11/2001 | Hansen et al. | |
| 6,715,795 | B2 * | 4/2004 | Klure | 283/62 |
| 6,957,737 | B1 | 10/2005 | Frederickson et al. | |
| 7,011,249 | B2 * | 3/2006 | Tang | 235/486 |
| 7,188,762 | B2 | 3/2007 | Goade, Sr. et al. | |
| 7,494,056 | B2 | 2/2009 | Sturm | |
| D598,280 | S | 8/2009 | Britt et al. | |
| 2006/0138768 | A1 * | 6/2006 | Abaygar et al. | 283/106 |
| 2007/0063052 | A1 * | 3/2007 | Chakiris et al. | 235/486 |
| 2009/0091123 | A1 * | 4/2009 | Conley et al. | 283/106 |
| 2009/0107862 | A1 * | 4/2009 | Pascua et al. | 206/232 |

* cited by examiner

*Primary Examiner* — J. Gregory Pickett
*Assistant Examiner* — Raven Collins
(74) *Attorney, Agent, or Firm* — Dicke, Billig & Czaja, PLLC

(57) ABSTRACT

A financial transaction card is packaged within a carrier which contains the card and prevents access to any indicia borne on the card (e.g., magnetic stripe, barcode, and the like) prior to activation of the financial transaction account associated with the card at the point of sale. The package bears no alternative indicia correlated with those borne on the card, and thus only the indicia on the card itself may be used for account activation. Such indicia are exposed at the point of sale by opening a section of the carrier to reveal the actual indicia borne on the card itself. Thus, any breakage of the carrier or other attempts to access the card within the packaging, prior to presentation of the packaged card for activation at the point of sale, is evidence of tampering of the package. In a preferred embodiment, the package is a simple three-panel, partially perforated construction that provides substantial security for the packaged card, at minimal manufacturing cost.

11 Claims, 7 Drawing Sheets

FINANCIAL TRANSACTION CARD PACKAGING HAVING REMOVABLE PORTION

TECHNICAL FIELD

This application involves packaging for financial transaction cards, particularly packaging that maintains the security of the card prior to activation of the financial transaction account associated with the card at the point of sale, such as commercial or retail store locations or kiosks.

BACKGROUND

Financial transaction cards (or, for this application, simply "cards") may be credit cards, stored value cards (also known as gift cards, prepaid cards, shopping cards, loyalty or reward cards, and so on) or other objects which function similarly (e.g., an object bearing a barcode, magnetic stripe, RFID chip or other feature recognizable at the point of sale to activate a financial account or subsequently perform or track a transaction or activity). Commonly shaped and sized "cards" have the form factor known as CR80, but CR50, CR79, CR90, and CR200 form factors also are common. Other, non-standard shapes and sizes exist as well. Cards may include a magnetic stripe, bar code or other indicia for identification, data transfer, account activation, verification, or other purposes.

The cards may or may not have value associated with them, i.e., the value may be already in the account ("on the card") before purchase, or it may be initially added ("loaded") or subsequently added ("reloaded") at point of sale or though any other form of data transmission used for electronic commerce.

Cards preloaded with value that are activated by indicia on a package containing the card represent a security (theft) risk. For example, prior to authorized purchase, a thief may access the activation indicia without physically removing the card from the package. The legitimate activation indicia on the package may be replaced with activation indicia correlated not with the legitimate card in the package, but instead with an illegitimate card (account) controlled by the thief. When the thief sees that the illegitimate account has been "activated" with the value that was intended for the account correlated with the legitimate card in the possession of the purchaser, the thief has stolen the amount of that transaction. The card within the package has not been activated at all.

SUMMARY OF THE DISCLOSURE

The transaction card packaging system of this application solves the problems described above, by completely concealing the activation indicia on the transaction card or otherwise attached to the transaction card, and not allowing such activation indicia to be accessed without indicating that the package has been tampered with prior to the point of sale. The account may be activated at the point of sale only by the activation indicia on the transaction card, and it is possible to do so because the construction and operation of the package provide convenient access at the point of sale to the activation indicia on the card. The package per se cannot activate the account.

Thus, in one aspect, a financial card transaction system comprises at least one financial transaction card mounted within a package (e.g. a folded carrier or assembly of panels) to conceal at least one indicia borne on the card for activation of an account. The package alone is incapable of activating the account or enabling the card to do so either. The package comprises an upper section and a lower section, the lower section comprising an upper portion and a lower portion detachable from the upper portion along a path to expose at least one of the indicia on the financial transaction card for activation of the account.

In another aspect, separating the lower portion of the lower section of the central and side panels exposes a lower section of the financial transaction card but does not release or otherwise allow the card to be removed from the package.

In yet another aspect, separating the lower portion of the lower section of the central and side panels by the perforations enables a lower section of the financial transaction card to extend from the carrier, again without being able to be removed from the package.

In yet another aspect, activation indicia may be borne on the interior of the package that is exposed by detaching a portion of the package, as opposed to (or in addition to) being borne on the card itself.

A package may be a folded carrier or an assembly of pieces attached (e.g., adhered or otherwise joined or affixed) together.

Still further aspects are included in the specific, but non-limiting, examples described below and depicted by way of illustration only in the accompanying drawings.

DETAILED DESCRIPTION

In the figures, a relatively thick solid line indicates a die or cut line; a relatively thin solid line indicates the outline or features of another object such as the financial transaction card; a thin dashed line indicates a perforated line; and a thin solid line indicates a score or fold line (or, "foldable [first, second, etc.] line").

Figure 6:
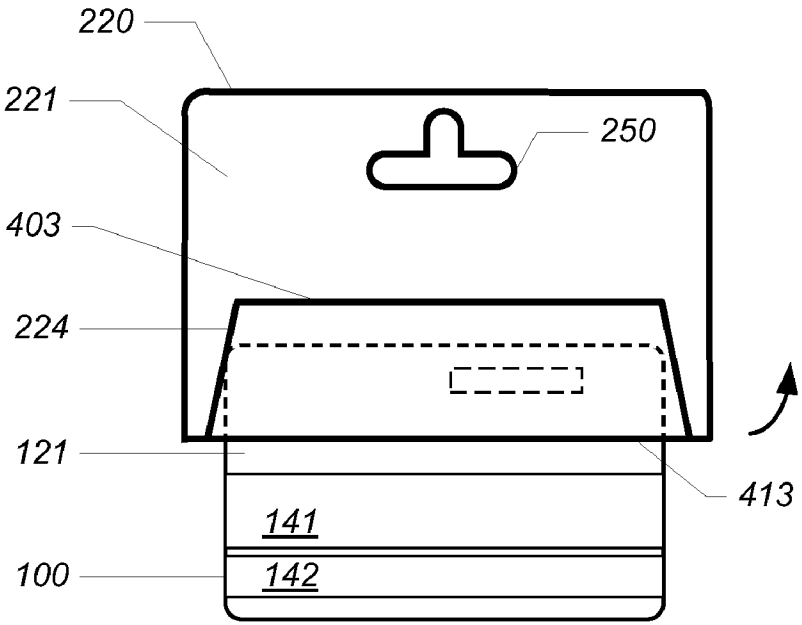
FIG. 6 illustrates the embodiment of FIG. 5 with a portion removed, enabling the financial transaction card to be activated.

FIGS. 1-4 are plan views of a preferred embodiment of a financial transaction card carrier, which is formed (in the preferred embodiment) from a single piece or substrate of material. The carrier is completely laid flat and unfolded to show its various components, including (in FIGS. 3 and 4) a financial transaction card borne by the carrier. FIGS. 5 and 6 illustrate the carrier when folded up to contain the card, forming a package suitable for display or sale of the card in retail or similar contexts (FIG. 5) and activation at the sales terminal (FIG. 6).

Carrier 200 comprises three generally rectangular contiguous panels: internal panel 210, central panel 220, and side panel 230. The single panels illustrated do not exclude multiple-panel embodiments performing the same functions as described and claimed below. For example, unless specifically described and claimed otherwise, panels that adjoin each other by a fold line may be replaced with distinct panel-shaped pieces of material from different substrates instead.

In the preferred embodiment illustrated, each panel is joined to its adjacent panel(s) by fold lines, such as fold line 411 which joins internal panel 210 and central panel 220. A similar fold line 412 joins the central panel 220 and side panel 230.

Figure 3:
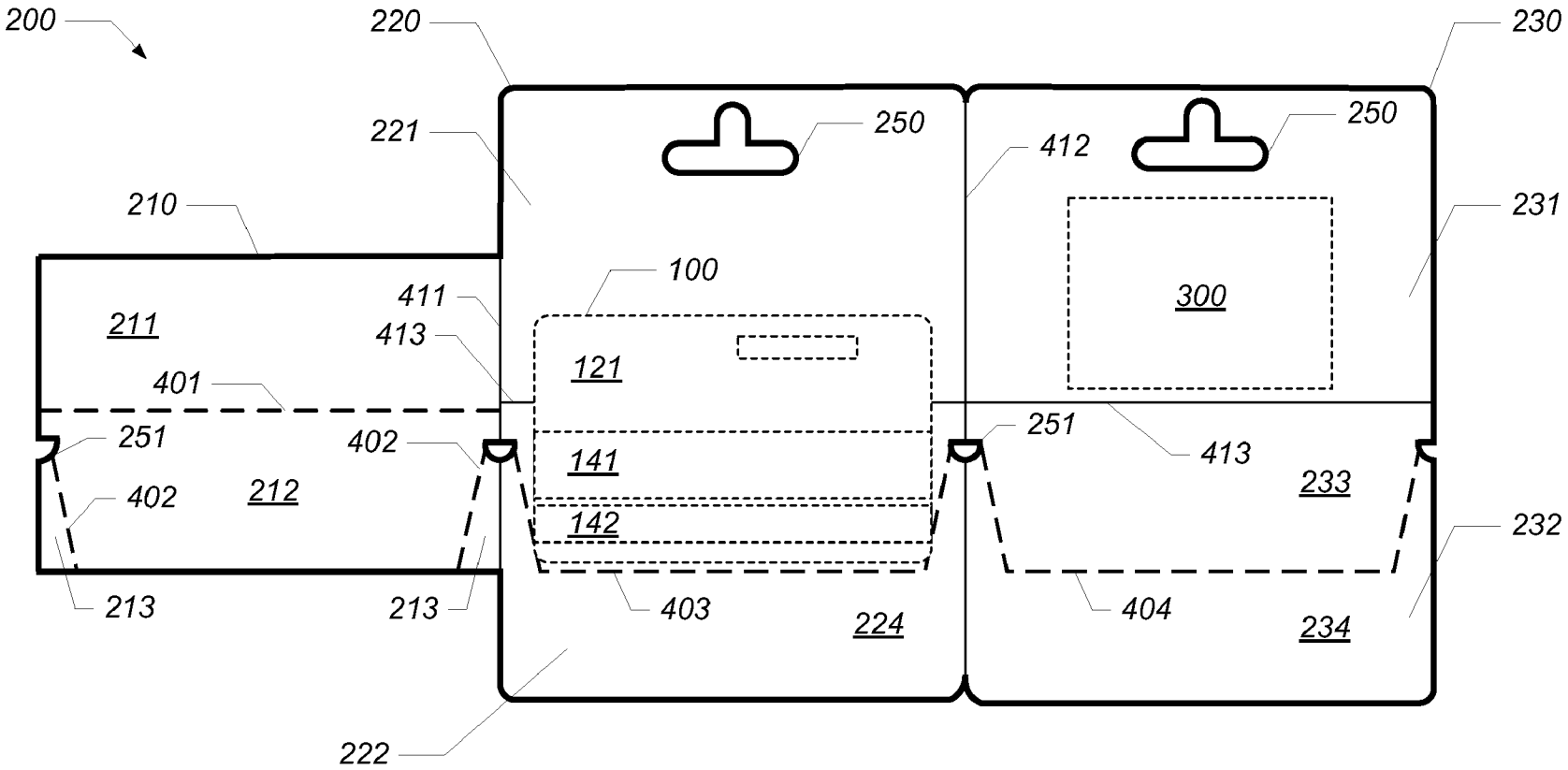
FIGS. 3 and 4 are respective views of the obverse and reverse sides illustrated in FIGS. 1 and 2, additionally showing the financial transaction card added to the card carrier.

As illustrated, each of the central and side panels may have an opening 250 or other feature to facilitate its display on a hook or rack or other fixture for storage, transportation, or display. It is also possible, but not required, to adhere or otherwise attach or include a flat object (such as a brochure or other printed material) to either portion. In FIG. 3, this "terms and conditions" insert is indicated as 300 and located on side panel 230.

In the preferred embodiment, each of the central and side panels is separated into two roughly identically sized and shaped sections, designated upper and lower, by an optional fold line 413 that is generally perpendicular to fold lines 411, 412. Thus, central panel 220 comprises upper section 221 and lower section 222, while side panel 230 comprises upper section 231 and lower section 232. Similarly, internal panel 210 is separated into two roughly identically sized and shaped portions 211, 212, designated upper and lower, respectively; but not by a fold line, but instead by a perforated line 401. In this preferred embodiment, line 401 is also slightly offset away from optional fold line 413 (if provided), on the order of 1/32 inch [0.8 mm] away, so that the two are not co-linear. This is found to improve the ability of the carrier material to fold along optional fold line 413 as described further below.

In turn, each of the lower sections 222 and 232 comprises an upper portion 223 and 233, respectively; and lower portions 224 and 234, respectively. Each lower portion 224, 234 is detachable from its respective lower portion 223, 233 by a perforated line (or its functional equivalent) 403, 404. Thus, perforated line 403 separates upper portion 223 and lower portion 224 of the lower section 222 of central panel 220, and perforated line 404 separates upper portion 233 and lower portion 234 of the lower section 232 of side panel 230. The perforated lines preferably have approximately seventeen perforations per inch, but this is only a preference.

The upper and lower portions of each lower section of central panel 220 and side panel 230 are not the same shape because perforated lines 403, 404 do not extend parallel to optional fold line 413 across the entire width of their respective lower sections 222, 232, but instead follow a generally U-shaped path. Specifically, each has two segments which turn upward from its major horizontal segment to extend to one of the D-shaped or "Half-D"-shaped features (holes) 251 that lie on the fold lines 411, 412 between panels, or on the exterior edge of the internal panel and side panel. Providing such features enables the lower portions of the carrier to be removed more easily than otherwise.

On interior panel 210, perforated lines 402 connect the lowermost die line of the lower portion 212 of internal panel 210 to D-shaped features 251. The location and angle of lines 402 match those of the upwardly directed segments of generally U-shaped perforated line 403. The lower portion 212 of internal panel 210 thus generally corresponds in shape and location to each of upper portions 222, 232.

Figure 4:
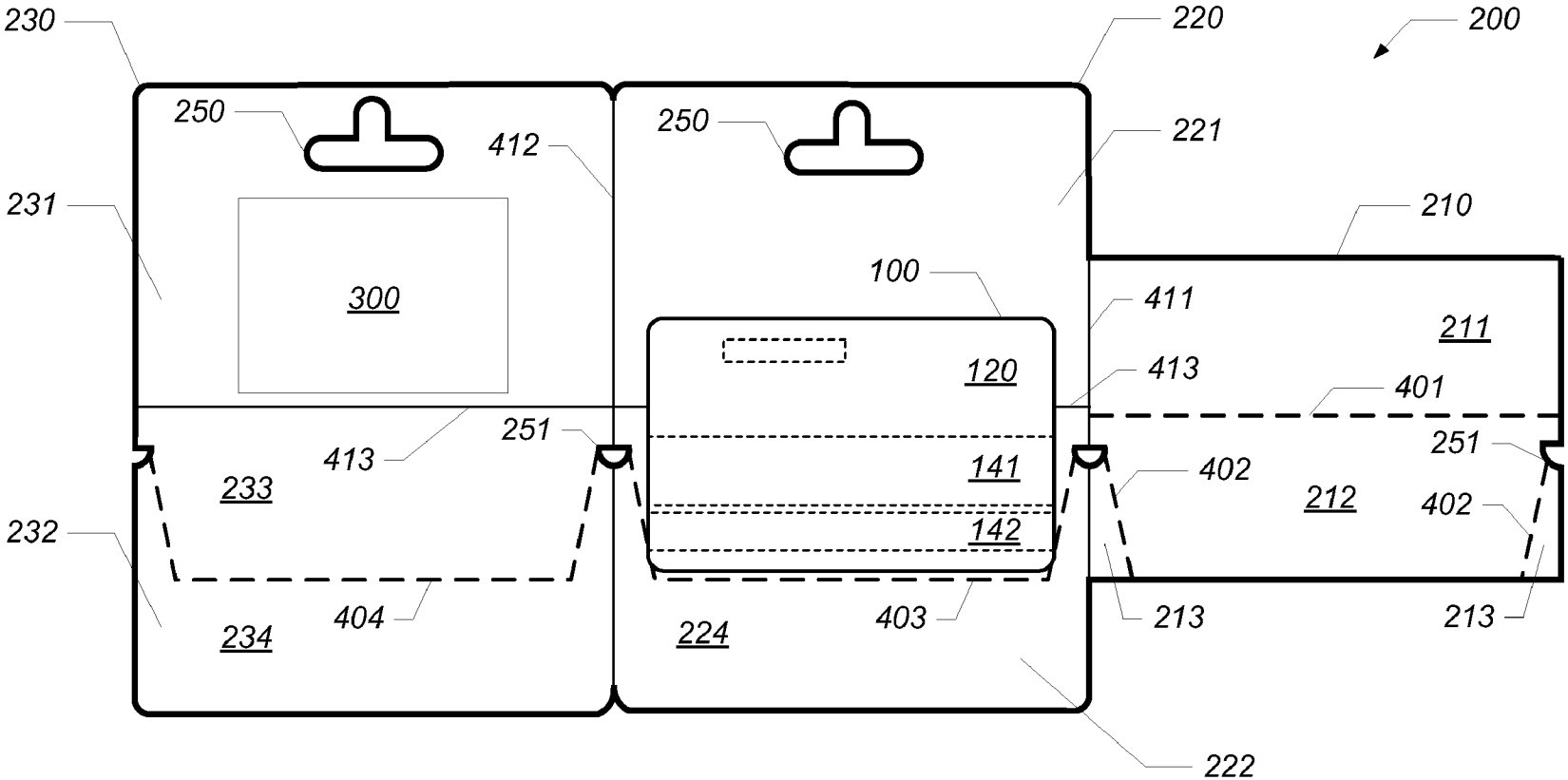
Figure 5:
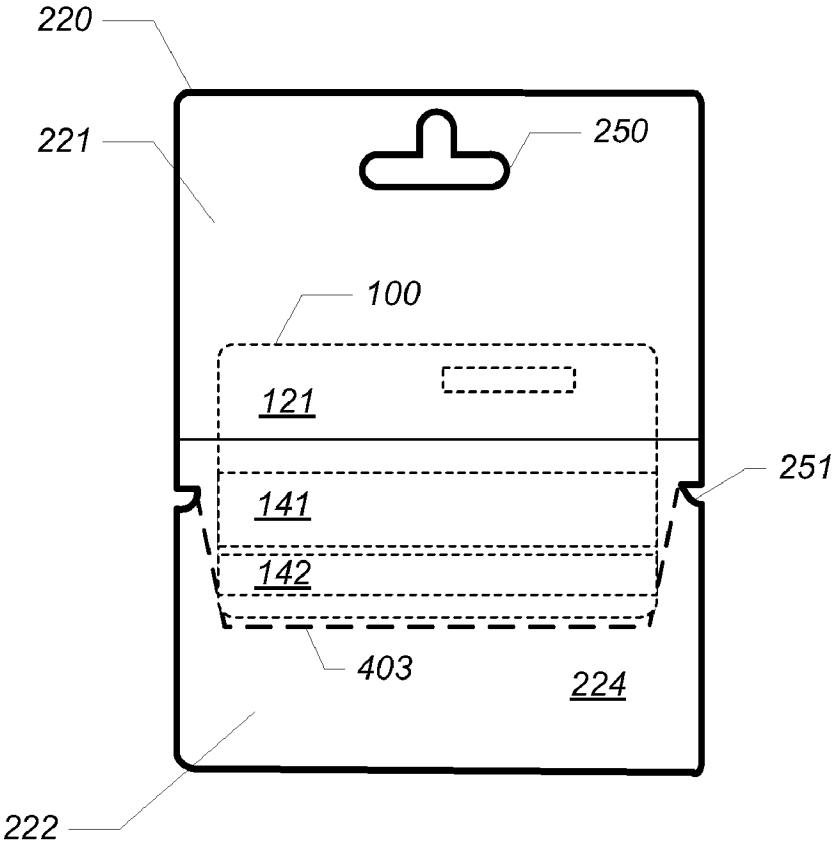
FIG. 5 is a plan back view of the preferred embodiment when completely folded together to package the card.

Turning briefly to FIGS. 3 and 4, card 100 is attached to a carrier 200 by any suitable technique, such as a line or dots of adhesive, i.e., the illustrated embodiment is a "two-piece" card/carrier combination in which the card is "tipped" or removably adhered (or the equivalent) to the carrier. Card 100, which lays back face down onto carrier 200, bears on its back face a barcode or other equivalent indicia 141, along with a magnetic stripe 142. Each of these is conventional and may encode various values as is well known in the art. In particular, either or both of these indicia are used to "activate" or subsequently access the financial transaction account represented by card 100, typically at the point of sale. Such access may be either to reduce the balance of the financial transaction account (i.e., use the account for purchases), to check the balance on the account, or to add to the account balance.

As known in the art, activation indicia may be borne on the interior of the package, as opposed to (or in addition to) being borne on the card itself.

As described below, when carrier 200 is folded around card 100, interior panel 210 is first folded along line 411 over the front face 120 of card 100, and then the interior or back face of side panel 230 is folded along line 412 until side panel 230 lines up with front panel 220 to form a completed system in which card 100 is secured in a tamper-evident manner within a package (in this case, folded carrier 200) and no activation indicia are accessible from outside the package; however, the package and card together form a financial transaction system because card 100 may be activated by opening package 200 to access one or more of activation indicia 141, 142 without removing card 100 from the package.

Additional resistance to tampering or other improper access to the financial transaction account arises in the case that card 100 bears an optional embossed account number on its front face 120 (not shown). In that case, the thickness of the carrier material, present over the embossed number in three layers—interior, center, and side—helps prevent feeling or otherwise "reading" the embossed number from outside the folded carrier or other form of package. It should be noted, however, that a carrier, package or system as defined by the claims will function identically for an embossed card as for a non-embossed card.

The sections of the three panels that surround card 100 (212, 223, and 233) are thus formed in a generally rectilinear shape (particularly, in the shape of a rhombus) and have upper and lower lines that are parallel to each other (i.e., optional fold line 413 is parallel to the opposite horizontal segment of perforated line 403 and 404, respectively) and perforated angled sides.

The lower portions 224, 234 each have a generally rectangular base 225, 235, respectively. Each also has two upwardly and outwardly extensions 226, 236 that extend to one of the adjacent D-shaped (or "half-D-shaped") features 251. Such extensions are generally matched in size and shape by wedges 213 forming sections of interior panel 210, which wedges improve the ability of the various panels to be attached to each other tightly along their edges when adhesive is used as described below.

Thus, returning to FIGS. 1 and 2, the outer face (when fully folded up) of each of central panel 220 and side panel 230 are shown; interior panel 210 is not visible when carrier 200 is fully folded to surround card 100. All faces illustrated in FIG. 2 are interior and thus concealed when the package is fully assembled. The terms "front" and "back" are with reference to the package as a whole, although it should be clear that the customer-facing "front" of the package, as well as the oppositely-facing "back" of the package, are each the faces of their respective panels. In the preferred embodiment, such panels are visible in FIG. 1 but are not visible in FIG. 2, thus the "front" of the finished package is the face of side panel 230 visible in FIG. 1, while the "back" of the finished package is the face of central panel 220 in the same Figure.

The back of the financial transaction card 100 may face the back of the package so that, if desired, an aperture or other means for making some or all of the back of the card visible may be incorporated into the central panel 220. If present, such an aperture could be any feature which allows viewing a selected portion of the card through itself, such as a physical opening without any covering, or such an opening with a transparent (or translucent) covering or similar material, or an equivalently functioning section of the carrier itself (e.g., a section of transparent material at the designated location). In this context, a feature or indicia of a card or section of the package may be visible because it is located within the package and is being viewed through an aperture, and not necessarily because it is on the outside of the package itself. Unless specifically described and claimed otherwise, an aperture may be any shape or size, and may be located in any position on any section of the package (e.g., any location on one or more panels of a carrier, folded or otherwise assembled into a package). The aperture allows for positive confirmation that a card is indeed within the package, or for reading yet another indicia from the card itself from outside the package. Thus, this convention also is consistent with current packaging for cards in which a duplicate or additional indicia is provided on the back of the package for indirectly activating the account associated with the financial transaction card 100.

As mentioned above, to assemble the combination of card and carrier, financial transaction card 100 is attached, adhered, affixed, or otherwise removably placed in the location illustrated, for example, by a pair of "dots" of releasable adhesive located on the upper two corners of card 100, but this is only an example. Financial transaction card carrier 200 is assembled into a package for card 100 by folding along each of the fold lines, and adhering certain portions together. Internal panel 210 is folded into the center of the carrier 200 over the card 100 at score line 411. Central and side panels 220, 230 are joined to each other in any convenient manner, such as adhering one or more edges together with a conventional adhesive. This manner of joining together the central and side panels is not a limitation on the scope of the invention, however.

The result is shown in FIGS. 5-6, with FIG. 5 showing the financial transaction card package comprising carrier 200 in its fully folded position and FIG. 6 showing a section removed (via the perforations described above) to allow access to the indicia for activation of the financial transaction card 100 as further described below.

In the most preferred embodiment for conventional CR 80 format financial transaction card (85.60 millimeter by 53.98 millimeter), internal panel 210 is approximately 3.9375 inches in width (the horizontal dimension as shown in the Figures) and 2.6875 inches in height (the vertical dimension as shown in the Figures). Central panel 220 is approximately 5.25 inches in height and 3 31/32 inches in width (between fold lines 411 and 412). Side panel 230 is also approximately 5.25 inches in height and approximately 4.0 inches in width.

Of course, these dimensions are not limitations on the scope of the invention, as they would depend upon the particular size of the piece of financial transaction card and other design factors, such as the amount of the card that is desired to be exposed once the financial transaction card carrier is opened. In this regard, it is clear that the height of the entire package may be extended by increasing only the height of each upper section 221, 231 of the central and side panels 220, 230, respectively. Changing other dimensions may be accomplished according to principles well within the ordinary level of skill in the art.

Turning specifically to FIGS. 5 and 6, to activate the account associated with financial transaction card 100, the assembled financial transaction card package is opened by breaking the perforations and removing the lowermost section of the assembled package, then folding the remaining (formerly upper) section of the lower half of the assembly out of the way of enclosed card 100. The enclosed card then extends out of the remaining upper half of the assembled package by at least approximately one-half inch. This enables the portion of the card bearing indicia on the back 121 of card 100 to be easily passed though a standard magnetic stripe reader. For activation systems in which both barcode 141 and magnetic stripe 142 must be accessed, the enclosed card extends out of the financial transaction card package by approximately one to one-and-one-sixteenth inch, although as much as one-and-five-sixteenth inch is easily provided by an internal panel of the height noted above.

In alternative embodiments (not illustrated), in which activation indicia are borne on the interior of the package, as opposed to (or in addition to) being borne on the card itself, such indicia may be placed, for example, on a portion that is exposed by detaching a portion of the package such as the interior face of lower portion 224, which may be folded as shown in FIG. 6 to enable passage through a magnetic stripe reader or reading by a barcode reader.

In the embodiment illustrated, in which the upwardly directed perforations (e.g. 402) connect to openings 251, there is a natural tendency for the remaining upper section of the lower half to fold up at the height of the openings 251. However, in some embodiments, the central and side panels 220, 230 may come apart and the folding thus occurs at a different location. To facilitate this, fold line 413 is provided, although in the most general case is not required at all; and if it is present in a preferred embodiment, its location is not critical provided it is located at or above the location of openings 251.

In any case, card 100 alone activates the account associated with the financial transaction card 100 directly, using the native indicia borne only on the card 100. Duplicate or surrogate indicia on the packaging are not used to activate the account and therefore are not essential. Apertures and similarly functioning features (e.g., transparent sections of the carrier) are not present. Nor is it essential to remove card 100 from the financial transaction card package to activate the account, because full access to the native activation indicia of card 100 is fully provided.

Figure 1:
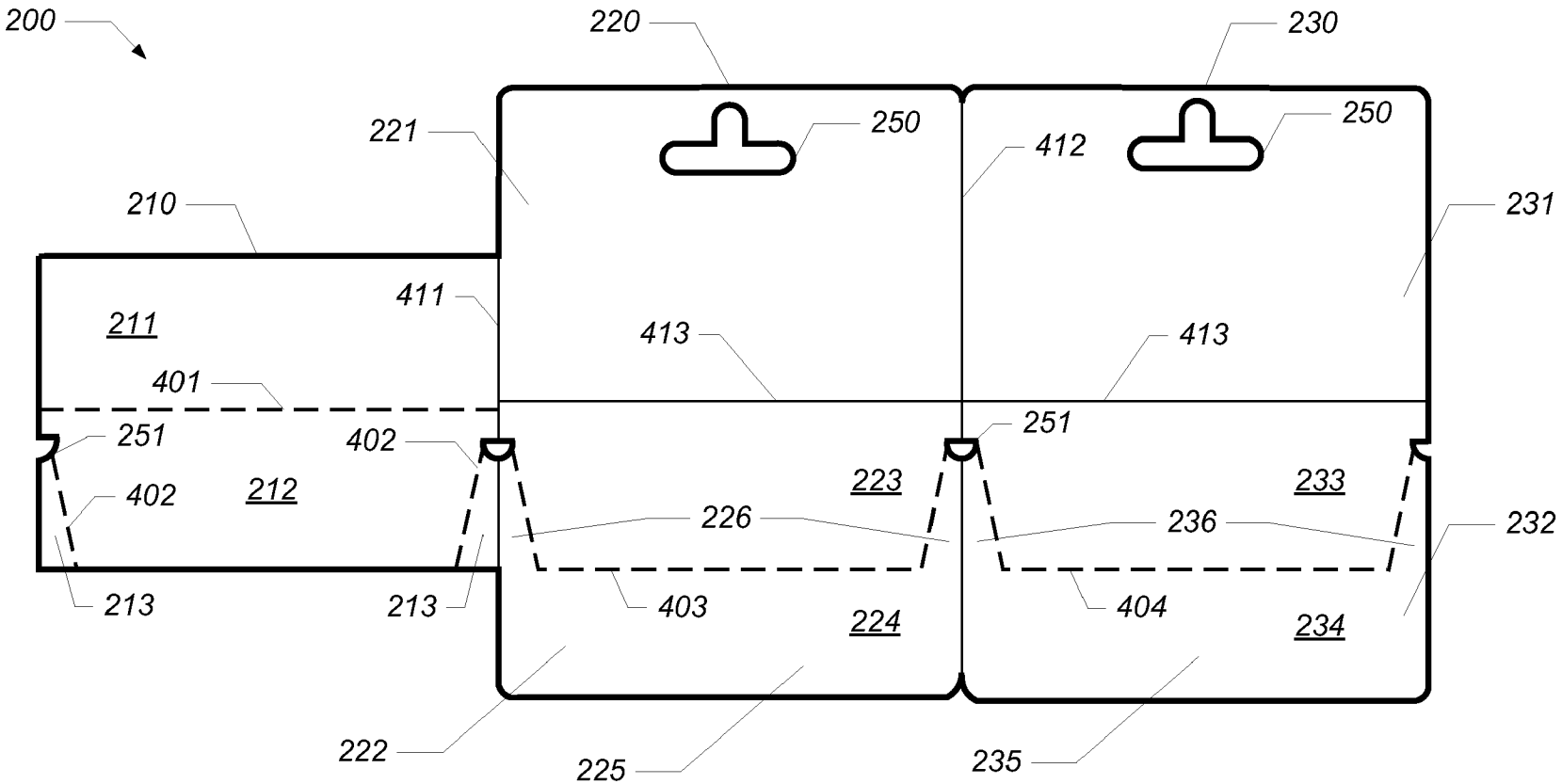
FIG. 1 is a plan view of an obverse side of a preferred embodiment of a financial transaction card carrier, completely laid flat and unfolded.
Figure 2:
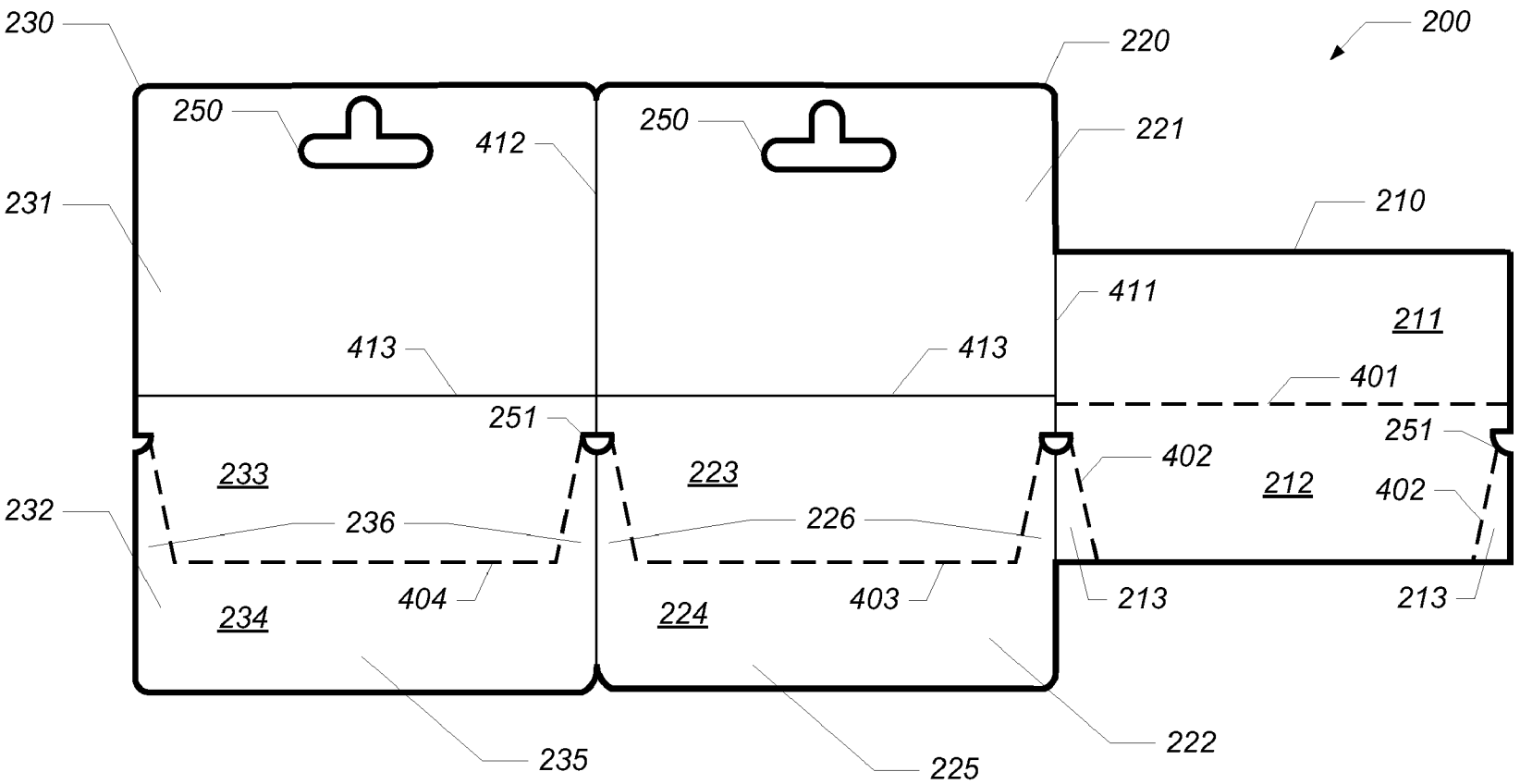
FIG. 2 is a plan view of a reverse face corresponding to FIG. 1.
Figure 7:
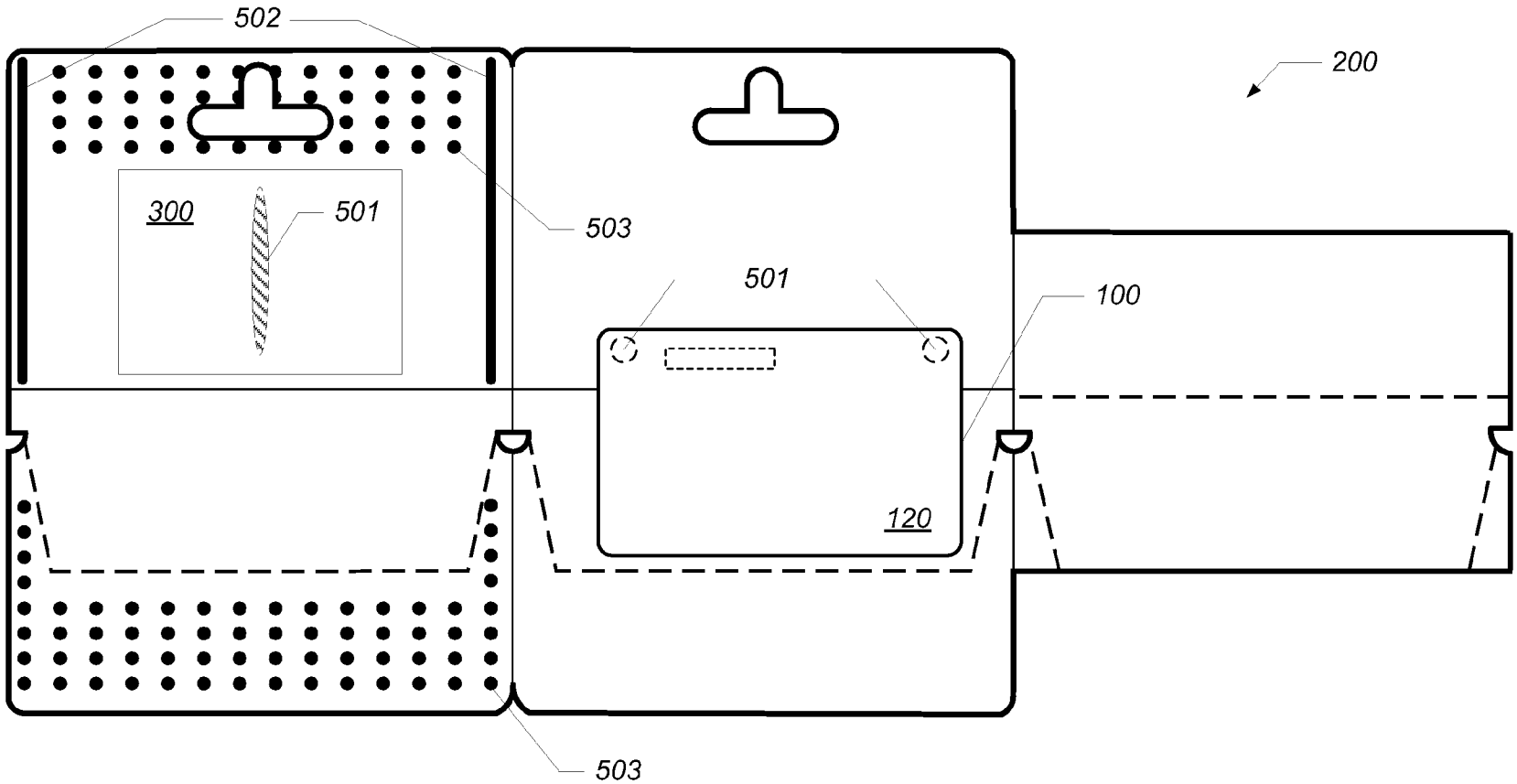
FIG. 7 is an alternative view of FIG. 4, illustrating locations for adhesives used in some embodiments.
Figure 8:
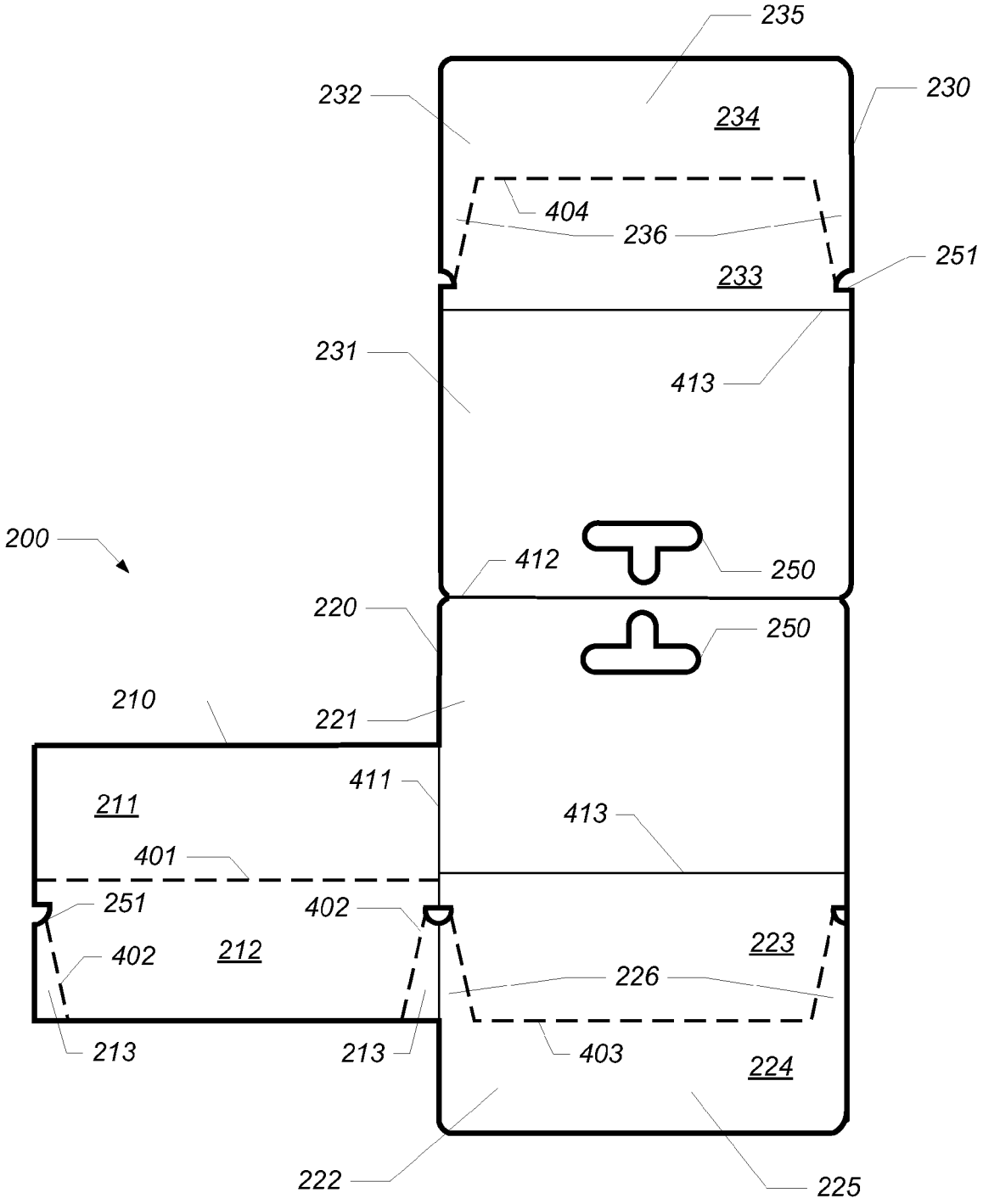
FIG. 8 is a view analogous to FIG. 1 of an alternative embodiment.

FIG. 8 illustrates an alternative embodiment in a view analogous to that of FIG. 1. Other views of this alternative embodiment are not included but are analogous to those of FIGS. 2-7, particularly FIGS. 5 and 6 because the final assembly and operation of the same are essentially the same in this non-preferred embodiment. This embodiment may require accurately aligning features of the assembled card and carrier, such as the apertures 250, 251. In this embodiment, the side panel 230 still adjoins central panel 220 at fold line 412, but not along the side of central panel 220 that is directly opposite the side at which internal panel 210 joins central panel 220 (i.e., fold line 411). This illustrates that the term "side" identifying side panel 230 is a label and not a structural or positional definition. This embodiment provides only a single fold line (specifically, fold line 411) on one side of card 100 in the fully assembled state. The other side of card 100 is adjacent the junction of the central and side panels 220, 230 which are only adhered together. Such a construction is less secure than a fold line, as it allows for a thief to slide a thin knife between the panels and remove card 100 by slitting the adhesive, removing the card, and re-adhering the panels to each other without visual evidence of tampering. A fold line between the two panels is more likely to indicate such tampering.

While any heavy paper or cardstock is suitable for the invention provided it can be cut and folded as described above, the preferred board stock is known as SBS C1S (solid bleached sulfate, coated one side), having a weight in the range from approximately from 200 lb to 17 pt, with 12 pt the most preferred. As is known in the art, the selection of material influences the selection of adhesive, and vice versa, but any adhesive providing suitable bonding strength, peel test characteristics, and the like is suitable.

The preferred adhesives are water-based ("cold") extrusion adhesives, but hot-melt adhesives are also believed to be acceptable. In particular, as illustrated in FIG. 7, a combination of both types is used for various reasons known to those skilled in the art, such as ease of application (particularly in critical locations such as the edges of the central and side panels), and penetration into fibers (if present) of the carrier material for additional strength and thus resistance to tampering. Releasable adhesives are used to secure card 100 and terms and conditions 300 to carrier 200.

In this vein, it should be understood in the description above, and in the following claims, that the word "adhere" and its variants (adhesive, adhesion, etc.) are to read as broadly defining the concept of attaching at least sections of various separate parts to each other, and thus such terms are intended to include other conventional and equivalent mechanisms, such as adhesive tapes (whether single-sided or double-sided in their use of adhesive).

General Considerations

In all of the embodiments described above, as well as in other aspects of the invention as claimed even if not explicitly described above, the following features and functions may apply.

Card Usage and Function

In general, financial transaction cards are associated with transaction accounts to provide access to cash equivalent value which is usable in an existing transaction system. Credit cards, for example, provide access to the credit account of the card financial transaction card carrier. Stored value cards (also called debit cards, gift cards, pre-paid cards, cash cards and so on) provide access to the cash balance of an account associated with the card before use of the card is allowed. In general, such an account is usable in transactions between a user and a merchant or other third party through any suitable communication network, such as, for example, a telephone network, intranet, the global public Internet, a point of interaction device, online communications, off-line communications, wireless communications, etc. They may also be used in person at any point of sale (automated or not) that accepts them. The type of stored value card may be a gift card, loyalty card, credit or debit card, health card, phone card, pre-paid phone card, membership card, identification card, ring tone card, or any other type of card.

Card Features

Unless disclosed and claimed otherwise, a financial transaction card may include one or more account identifying elements. Suitable forms include magnetic stripe, radiofrequency identification (RFID), bar code, and text (recognized by Optical Character Recognition (OCR)). The account identifying element is encoded with data, which includes a unique account number along with other data as required. More than one account identifying element may be included, and in any location.

If the card includes a magnetic stripe, that magnetic stripe may comprise a plastic film including tiny magnetic particles that can be magnetized in certain directions to record data on the card, which may be read by a card reader.

If the card includes a bar code, the bar code may comprise machine-readable data, which may be alpha-numeric. Bar code data includes black and white lines arranged to represent a series of numbers (e.g., a bar code comprising a Universal Product Code (UPC) has twelve digits) to a bar code scanner (printed account identifying elements).

Other current or future developed account identifying elements are also possible.

The card may include embossed or non-embossed features. An account identifying element(s) on the stored value card may be embossed (including at least one raised section (e.g., letters, designs), or protuberance, etc.), or non-embossed.

Card Construction

Unless disclosed and claimed otherwise, the financial transaction card, while typically the size and shape of a conventional credit card (i.e., the CR80 format), may be any size and shape consistent with other relevant requirements. Possible materials include plastic, wood, and paper; but other materials (synthetic or natural) are possible. Specific examples include poly(vinylchoride) or PVC; polylactic acid or PLA; polycarbonate; polystyrene; paper; and cardstock. Cards may be manufactured individually (e.g., injection or other forms of molding) or cut from sheets. As known in the art, a completed card may be a monolithic substrate ("single core") bearing functional layers, or it may be the result of joining two or more subassemblies that have been individually manufactured and then joined together to form a completed (or partially completed) card ("split core").

Indicia

Unless disclosed and claimed otherwise, an indicia borne on a card or carrier may be a magnetic stripe (conforming to international standards or otherwise) capable of being "read" or otherwise interpreted into an alphanumeric string of characters; a barcode (one dimensional or two dimensional), printed text or numbers, embossed text or numbers, a RFID tag, biometric feature, or any text or graphic logo imprinted or otherwise borne on the card. The exact quantities, locations, data formats, and functions of any indicia are limited only by the claims. Any indicia may explicitly appear as an alphanumeric sequence (e.g., account financial transaction card carrier name or account number) or may represent such a sequence (e.g., a barcode that may or may not be accompanied by a printed representation of some or all of the data encoded into the barcode). Multiple instances of indicia may be included (e.g., a single indicia repeated at a different location—such as an account number that is both embossed into the front of the card and printed on the back of the card; or two indicia which each individually is insufficient to uniquely identify a card or account but which do so when taken together with each other or with other information). Common indicia include one or more account numbers; card serial numbers; activation indicia; manufacturing information; packaging information; personal data (e.g., the "personal identification number" or PIN, or other "personal" data such as (for example) the customer verification value or "CVV" used in some transaction systems).

Card Manufacture

Unless specifically described and claimed otherwise, a card or carrier may be manufactured by conventional techniques or any other techniques that produce the same result. Conventional manufacturing steps including pretreatment, UV (or equivalent) printing, press polishing, lamination, die cutting (or punching), and the like, all having the meanings and scope known in the art. Similarly, the manufacturing process may be sheet-fed or web-fed in nature, such terms and techniques again having the meanings and scope known in the art.

Graphics

One or more graphics may be included on a card or carrier or package. Examples include pictorial information of any kind (typically, but not exclusively, on the front or customer-facing side of the card or carrier or both). Graphics may be combined (or coordinated) with indicia in any convenient manner. The preferred method of providing graphics is printing with UV-cured inks, as is well known in the art.

Carrier Construction

The carrier includes one or more panels, as shown in the figures, and each panel may be made of more than one piece of material. Preferably, the carrier is made of paper or cardstock; however other materials, such as polymeric materials (similar to if not the same as those from which cards themselves are manufactured) or synthetic paper, are also suitable. The material may be laminated on one or more sides with a transparent material capable of receiving printed material. The laminating material may be a plastic material such as polyvinyl chloride (PVC), polyethylene terephthalate (PET), polyethylene terephthalate glycol (PETG), or acrylonitrile butadiene styrene (ABS). The laminating material may be bonded or applied to the sheet of material in a conventional matter. The laminating layer provides the carrier with a certain degree of rigidity, for improved handling during manufacture and afterward. It also helps protect any graphics or other information which may be present.

Card and/or Carrier Indicia

While not shown in the figures, the front and/or rear of the systems (card and/or carrier) may be printed with information to promote the card when it is displayed at a retail establishment location, such as the name or logo of the retail establishment, a predetermined amount or value of the card, instructions for use, various commercial text (e.g., legal text) and so forth.

Numbers and Types of Cards

Unless specifically described and claimed otherwise, a card and carrier system may include single or multiple cards associated with a given carrier. When present, multiple cards may be identical or coordinated with each other, e.g., two or more cards in a single package may be linked to or otherwise correlated with a single financial account or multiple financial accounts, even if the cards are not otherwise identical to each other.

The following claims may use the language "first," "second," "third," and so on to specifically distinguish between various elements that are otherwise similarly named, such as fold lines, edges, and the like. These terms are not intended to imply any order of importance or time sequence in the manufacturing or use of the invention, unless other claim language specifically does so.

In the context of attachment of one piece to another, it should be understood that a "line" of attachment may be a region of attachment which is longer than it is wide, the "line" being the longer dimension. It is not necessarily so that the region is continuous, i.e., either a line of adhesive or a line of "dots" of adhesive may form an attachment line, as may a perforated line. Nor is it necessary that the pieces first be separate pieces subsequently brought together. That is, an "attachment" line may be a fold line formed in a single piece of material to create two adjoining panels or sections of a panel.

It is also clear that the appearance and manner in which the financial transaction card functions are not limitations on the scope of the invention, except as described above and in the following claims.

We claim:

1. A financial transaction card carrier, comprising:

a) an internal panel attached along a first fold line to one side of a central panel, and a side panel attached along a second fold line to a second side of the central panel;

b) the internal panel comprising an upper section and a lower section detachable from the upper section by a perforated third line generally perpendicular to the first fold line;

c) each of the central and side panels being foldable to form respective upper and lower sections of each of the central and side panels;

d) each lower section of each of the central and side panels comprising an upper portion and a lower portion removable from its respective upper portion along a detachable perforated U-shaped path comprising a horizontal segment and a pair of upwardly and outwardly directed extensions adjacent one of the first and second fold lines.

2. The carrier of claim 1, in which each of the each of the central and side panels is foldable generally in half.

3. The carrier of claim 1, in which each lower section of each of the central and side panels is generally rectilinear.

4. The carrier of claim 1, in which the detachable path of each lower portion of each lower section of each of the central and side panels is generally shaped like a lower section of a financial transaction card.

5. A financial transaction package, comprising:

a) an internal panel attached along a first attachment line to a central panel, and a side panel attached along a second attachment line to the central panel;

b) the internal panel comprising an upper section and a lower section detachable from the upper section by a perforated third line generally perpendicular to the first attachment line;

c) each of the central and side panels having respective upper and lower sections, each lower section of each of the central and side panels comprising an upper portion and a lower portion removable from its respective upper portion along a detachable perforated U-shaped path comprising a horizontal segment and a pair of upwardly and outwardly directed extensions adjacent one of the first and second fold lines.

6. The package of claim 5, in which at least one of the first and second attachment lines is a fold line.

7. The package of claim 5, in which at least one of the first and second attachment lines is an adhesion line.

8. The package of claim 5, in which each of the each of the central and side panels is foldable generally in half.

9. The package of claim 5, in which each lower section of each of the central and side panels is generally rectilinear.

10. A financial transaction system, comprising a carrier having an internal panel attached along a first fold line to one side of a central panel, and a side panel attached along a second fold line to a second side of the central panel; the internal panel comprising an upper section and a lower section detachable from the upper section by a perforated third line generally perpendicular to the first fold line; each of the central and side panels being foldable to form respective upper and lower sections of each of the central and side panels; each lower section of each of the central and side panels comprising an upper portion and a lower portion removable from its respective upper portion along a detachable perforated U-shaped path comprising a horizontal segment and a pair of upwardly and outwardly directed extensions adjacent one of the first and second fold lines to expose by detachment of the lower portion from the upper portion at least one indicia for activation of an account; and a financial transaction card, with which the account is associated, mounted to the carrier.

11. A financial transaction card carrier, comprising:

a) an internal panel attached along a first fold line to one side of a central panel, and a side panel attached along a second fold line to a second side of the central panel;

b) the internal panel comprising an upper section and a lower section detachable from the upper section by a perforated third line generally perpendicular to the first fold line;

c) each of the central and side panels being foldable to form respective upper and lower sections of each of the central and side panels;

d) each lower section of each of the central and side panels comprising a generally rhombus-shaped upper portion and a generally rectangular lower portion removable from its respective upper portion along a detachable U-shaped perforated path, which path comprises a horizontal segment and a pair of upwardly and outwardly directed extensions adjacent one of the first and second fold lines.

* * * * *